US006682359B1

(12) United States Patent
Hitchcock et al.

(10) Patent No.: US 6,682,359 B1
(45) Date of Patent: Jan. 27, 2004

(54) ELECTRICAL CONNECTOR ASSEMBLY WITH CONNECTION ASSURANCE FEATURES

(75) Inventors: Matthew B. Hitchcock, Harrisburg, PA (US); James E. Gundermann, Palmyra, PA (US); Matthew F. Foriska, Harrisburg, PA (US); John R. Shuey, Mechanicsburg, PA (US); Vincent M. Kane, Harrisburg, PA (US); Aaron J. Shuman, Harrisburg, PA (US); Galen M. Martin, Camp Hill, PA (US); John M. Myer, Millersville, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/313,665

(22) Filed: Dec. 6, 2002

(51) Int. Cl.[7] ..... H01R 13/62
(52) U.S. Cl. ..... 439/157; 439/153; 439/372
(58) Field of Search ..... 439/152, 153, 439/154, 157, 160, 372

(56) References Cited

U.S. PATENT DOCUMENTS

| | | | | |
|---|---|---|---|---|
| 5,453,016 A | | 9/1995 | Clark et al. | |
| 6,305,957 B1 | * | 10/2001 | Fink et al. | 439/157 |
| 6,325,647 B1 | | 12/2001 | May et al. | |
| 6,371,778 B1 | * | 4/2002 | Watanabe | 439/157 |
| 6,558,176 B1 | * | 5/2003 | Martin et al. | 439/157 |
| 6,595,790 B1 | * | 7/2003 | Bigotto | 439/157 |

* cited by examiner

*Primary Examiner*—Truc Nguyen

(57) ABSTRACT

An electrical connector is provided including matable first and second housings configured to receive electrical contacts. The electrical connector assembly includes a lever member having a cam arm engaging the first and second housing to connect the first and second housings to join corresponding electrical contacts. The first housing has a latch assembly engaging the lever member when the lever member is in a final engaged position. The first housing has a locking member that holds the cam arm in an insertion position. The first housing has a wire shield with feet and a tab that is retained in slots and a catch on the first housing. The electrical contacts have retention features that are retained in an encapsulate in a chamber abutting the second housing.

8 Claims, 21 Drawing Sheets

B
10
22
154
38
30
166
158
170
70
120
106
98
162
D

ELECTRICAL CONNECTOR ASSEMBLY WITH CONNECTION ASSURANCE FEATURES

RELATED APPLICATIONS

This application is related to Ser. No. 10/273,655, filed Oct. 18, 2002, titled "Electrical Connector Assembly With Connection Assurance Features," the subject matter of which is incorporated herein by reference.

BACKGROUND OF THE INVENTION

Certain embodiments of the present invention relate to an electrical connector assembly that uses connection assurance features for mating resisting components. More particularly, certain embodiments of the present invention relate to an electrical connector assembly having connection assurance features that engage a lever member on a mate assist assembly.

In certain applications, electronic components require an electrical connector assembly that joins first and second housings containing electrical contacts. One housing includes male electrical contacts, while the other housing includes female electrical contacts. The first housing is configured to be received inside the second housing such that the male and female electrical contacts are electrically connected. The electrical contacts retained within the first housing extend to a rear wall and are connected to wires that extend outward from the first housing to an electronic component. A wire shield is attached to the first housing about the rear wall to cover the wires. The wire shield has slots along flexible members that receive tabs extending from the rear wall to hold the wire shield about the rear wall.

The electrical contacts retained within the second housing extend through a rear wall down through a template positioned perpendicularly to the rear wall such that intermediate portions of the electrical contacts are uncovered. Tail ends of the electrical contacts extend through the template to be press fit into printed circuit boards. Tooling is used to support the uncovered intermediary portions of the electrical contacts when the electrical contacts are press fit into the printed circuit boards.

In a traditional electrical connector assembly, the first housing is connected to the second housing by hand. In order to be sure that the first and second housings are properly connected with the electrical contacts electrically engaged, the first and second housing are provided with a latch assembly more generally referred to as a position assurance feature. The latch assembly includes a base plate and a suspended prong on the first housing and a ramp on the second housing. The base plate is slidably retained beside the prong. When the first housing is inserted about the second housing, the prong snaps over the ramp and the base plate is then slid over the ramp and the prong into an engagement position. When the base plate is in the engagement position, an operator is assured that the first and second housings are fully connected.

However, as the number of electrical contacts to be mated increases, it becomes difficult to fully join the first and second housings because of friction between the mating electrical contacts. Therefore, a mate assist assembly is used to provide the force necessary to connect the first and second housings. The typical mate assist assembly is a lever member connected to one of the housings which has cam arms that engage racks on the other housing as the lever member is rotated through a range of motion. The interaction of the cam arms and the racks provides force to overcome the friction between the electrical contacts and easily connect the first and second housings. Typically, electrical connector assemblies with a lever member do not include a latch assembly because the lever member and latch assembly interfere with each other in conventional designs.

The typical electrical connector assembly with a mate assist assembly suffers from a number of drawbacks. First, the lever member may be positioned such that when the first housing is connected to the second housing, the cam arms of the lever member are improperly aligned with the racks. Therefore, the lever member may be rotated to a position that indicates the first and second housings are fully joined without having engaged the racks to connect the first and second housings. Thus, the first housing may only loosely be retained about the second housing such that the electrical contacts are not connected, even though the first and second housings may appear to be fully connected.

Also, the wire shield is difficult to remove and attach to the first housing. The wire shield is removed from the first housing by using a tool to pry the flexible members outward away from the rear wall to separate the slots in the flexible members from the tabs. Likewise, the wire shield is attached to the first housing by prying the flexible members outward such that the slots receive the tabs. Therefore, anytime an operator wishes to have access to the wires or the rear wall of the first housing, the operator has to have special tooling and take the time to pull each tab out of a corresponding slot.

Further, the use of the tooling to support the electrical contacts extending from the second housing when the tail ends are press fit into the printed circuit boards is time consuming and difficult. When an operator wishes to connect the electrical contacts to the printed circuit boards, the operator must use special tooling and separately hold each group of electrical contacts during interconnection, which is time consuming. Also, the tooling is too bulky to be used on closely aligned electrical contacts, and thus certain alignments of electrical contacts can not be used with the second housing.

Therefore, a need exists for a connector assembly that overcomes the above problems and addresses other concerns experienced in the prior art.

BRIEF SUMMARY OF THE INVENTION

Certain embodiments provide an electrical connector assembly including first and second housings having ends configured to receive electrical contacts. The first and second housings are configured to be matable with one another to join corresponding electrical contacts. The electrical connector assembly includes a lever member including a cam arm received by the first housing and engaging the second housing as the lever member is rotated through a range of motion. The lever member connects the first and second housings to join corresponding electrical contacts when the lever member is rotated to a final engaged position. The first housing has a latch assembly that engages the lever member when the lever member is in the final engaged position. The latch assembly has a base piece and a latch cover. The base piece has first and second latches. The second latch engages the latch cover when the latch assembly is in a pre-engagement stage. The lever member engages the first latch when rotated to the final engaged position to bias the second latch away from the latch cover thereby enabling the base piece to slide into an engagement stage with respect to the latch cover.

Certain embodiments provide an electrical connector assembly including first and second housings having ends configured to receive electrical contacts. The first and second housings are configured to be matable with one another to join corresponding electrical contacts. The first and second housings are movable between initial and final mating positions. The electrical connector assembly includes a lever member having a cam arm received by the first housing and engaging the second housing as the lever member is rotated through a range of motion beginning at an insertion position. The lever member connects the first and second housings to join corresponding electrical contacts when the lever member is rotated through the range of motion. The lever member includes a release arm proximate the cam arm. The first housing has an end wall with a locking member engaging the release arm to maintain the lever member in the insertion position with respect to the first housing. The second housing has a release member aligned to engage the release arm and bias the release arm away from the locking member on the first housing in order to release and permit rotation of the lever member from the insertion position when the first and second housings are in the initial mating position.

Certain embodiments provide an electrical connector assembly including a first housing configured having electrical wires extending out of a reception end thereof and a wire shield extending from the first housing and covering the reception end. The wire shield has feet and a tab extending from walls. The first housing has slots receiving the feet and a catch releasably retaining the tab.

Certain embodiments provide an electrical connector assembly including contacts having top portions, intermediate portions, and bottom portions. The bottom portions have retention features. The electrical connector assembly includes a housing having a shroud mounted to a rear wall. The rear wall retains the top portions of the contacts within the shroud of the housing. The electrical connector assembly includes a template having a chamber and receiving the bottom portions. The chamber includes at least one of an open side and open end. The housing and the template are mounted to each other to receive an encapsulate material in the chamber that encases the bottom portions about the retention features.

Figure 1:
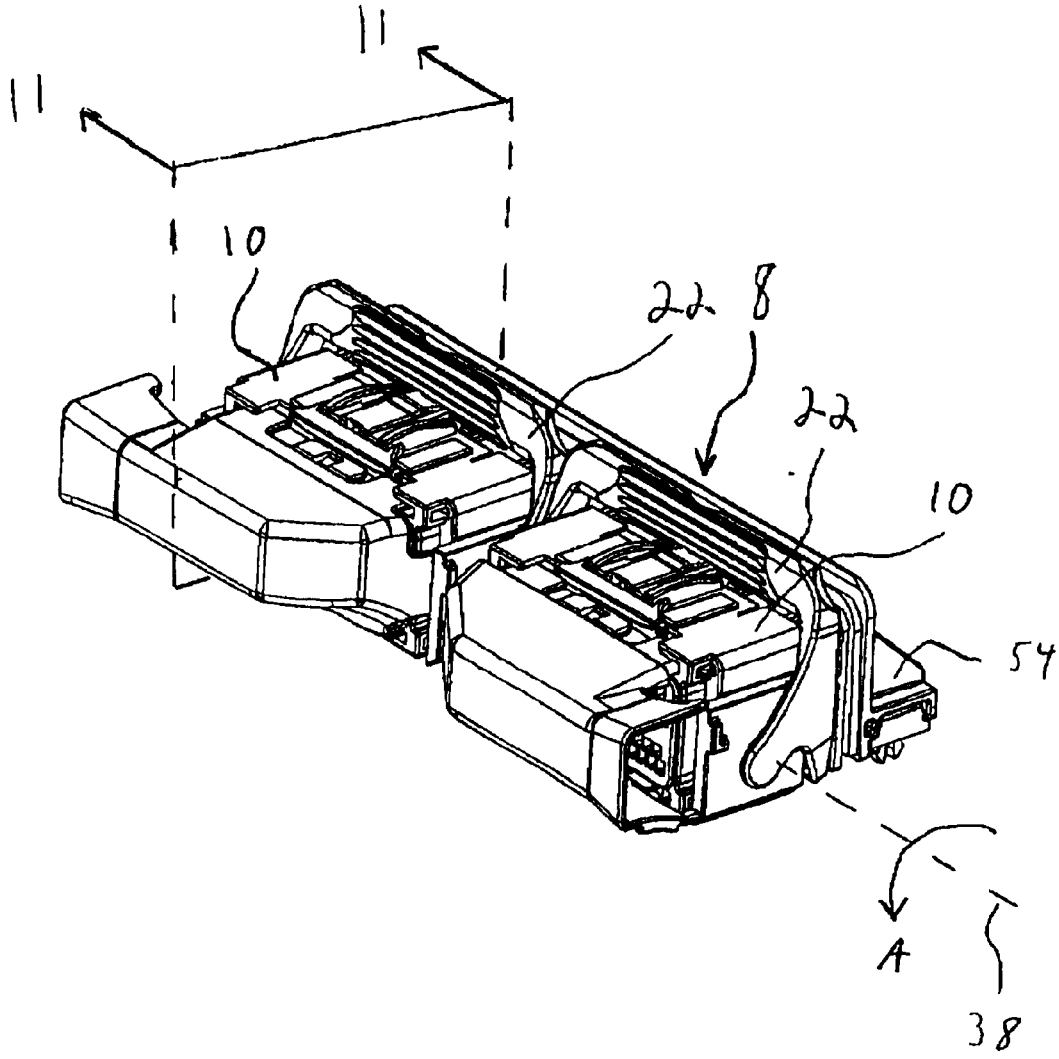
FIG. 1 illustrates an isometric view of a mate assist assembly according to an embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentality shown in the attached drawings.

DETAILED DESCRIPTION OF THE INVENTION

FIG. 1 illustrates an isometric view of an electrical connector assembly 8 according to an embodiment of the present invention. The electrical connector assembly 8 includes harness connectors 10 carrying groups of receptacle contacts (not shown). A header connector 54 holds plug contacts 74 (FIG. 2) configured to mate with the receptacle contacts in the harness connectors 10. The harness connectors 10 are fully inserted onto the header connector 54 to a final mating position. Lever members 22 are retained on the exterior of the harness connectors 10 and engage the header connector 54. The lever members 22 are shown in a final engaged position. The lever members 22 are rotatable in the direction of arrow A about a rotational axis 38 to move the harness connectors 10 from the final mating position to disengage the electrical contacts.

Figure 2:
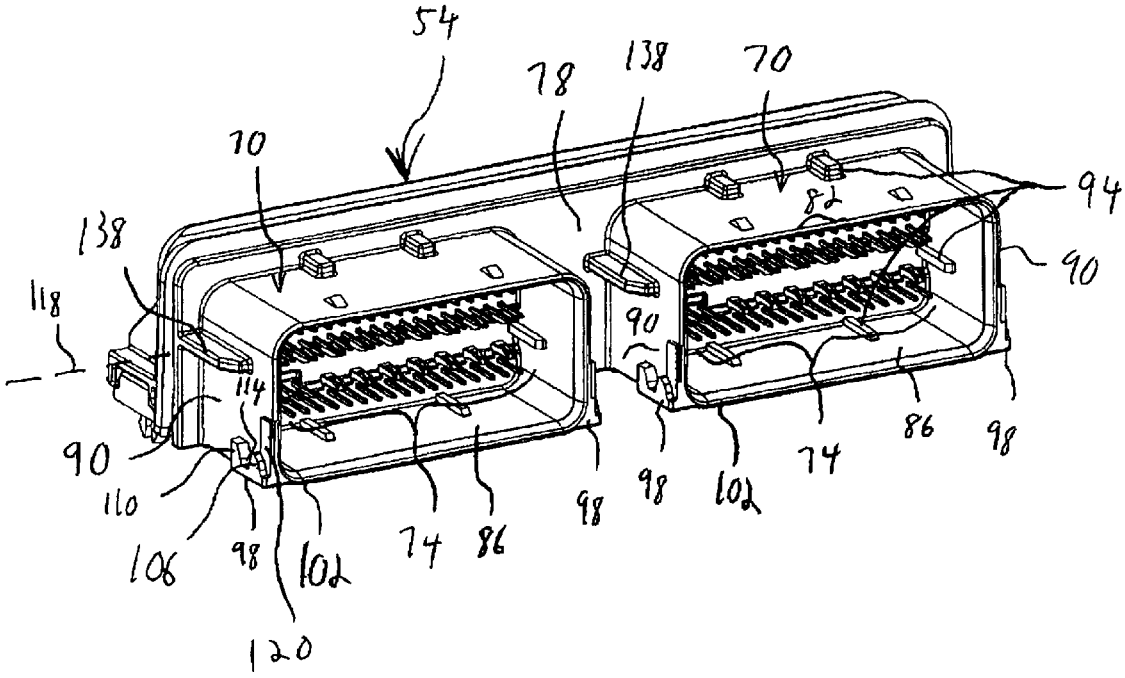
FIG. 2 illustrates a front isometric view of the header connector formed according to an embodiment of the present invention.

FIG. 2 illustrates a front isometric view of the header connector 54 formed along a longitudinal axis 118. The header connector 54 includes two rectangular shrouds 70 that enclose plug contacts 74 extending from a rear wall 78. The plug contacts 74 extend through the rear wall 78 and are connected to an electronic component (not shown). The plug contacts 74 are received by the receptacle contacts within the harness connectors 10 (FIG. 1) when the harness connectors 10 engage the header connector 54. The shrouds 70 are defined by opposite top and bottom walls 82 and 86 formed with side walls 90. The top, bottom, and side walls 82, 86, and 90 include alignment features 94 along interior and exterior wall surfaces that are received by corresponding alignment gaps 126 (FIG. 3) within the harness connectors 10. The alignment features 94 ensure that the harness connectors 10 are slidably inserted about the shrouds 70 in the proper orientation. The side walls 90 include release members 138 that engage the lever member 22 (FIG. 1) when a harness connector 10 is inserted onto a shroud 70.

Racks 98 are provided that extend outward from each side wall 90 and are located proximate a rear edge forming a shroud rim 102 where the side walls 90 meet the bottom walls 86. Each rack 98 includes first and second teeth 106 and 110 separated by a catch gap 114. A rectangular blocking member 120 extends outward from the side wall 90 alongside the shroud rim 102 proximate the rack 98. The blocking member 120 extends outward from the side wall 90 a shorter distance than the rack 98. The rack 98 engages a cam arm 30 (FIG. 3) of the lever member 22, and the lever member 22 is rotated to move the harness connectors 10 to the final mating position about the header connector 54. The blocking member 120 engages the cam arms 30 to prevent the harness connectors 10 from being inserted onto the header connector 54 to an initial mating position unless the lever member 22 is oriented in an insertion position.

Figure 3:
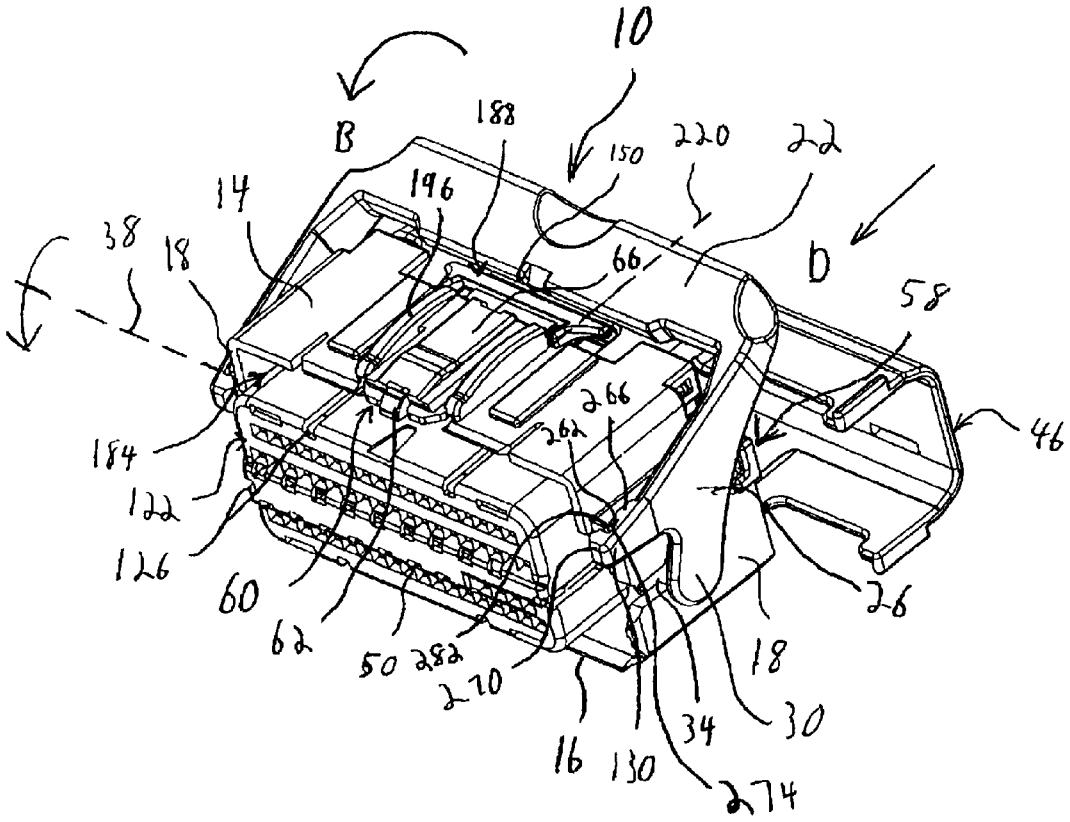
FIG. 3 illustrates a top isometric view of a harness connector and a lever member formed according to an embodiment of the present invention.

FIG. 3 illustrates a top isometric view of a harness connector 10 and a lever member 22. The harness connector 10 includes opposite side walls 14 and 16 formed with opposite end walls 18 to enclose a contact block 122. A shroud gap 184 extends within the harness connector 10 between the contact block 122 and the side walls 14 and 16 and end walls 18. The contact block 122 includes receptacle cavities 50 that carry the receptacle contacts and alignment gaps 126 that receive the alignment features 94 of the shroud 70 (FIG. 2). The receptacle contacts are connected to wires (not shown) at a reception end 58, and the wires extend to an electronic component (not shown). A box-shaped wire shield 46 extends from, and covers, the reception end 58 to protect the wires from outside elements. In operation, the harness connector 10 receives the shroud 70 within the shroud gap 184. As the harness connector 10 receives the shroud 70, the receptacle contacts receive, and are electrically connected to, the plug contacts 74 (FIG. 2) positioned within the header connector 54 (FIG. 2).

The lever member 22 is connected to the end walls 18 by lever arms 26. Each lever arm 26 includes the cam arm 30 and a release arm 130. The cam arm 30 is received in an aperture 34 in the end wall 18 of the harness connector 10 and engages the rack 98 (FIG. 2) on the shroud 70 as the lever member 22 is rotated through a range of motion. As shown, the lever member 22 is in the insertion position. When the lever member 22 is in the insertion position, the harness connector 10 may be inserted into the shroud 70 without the blocking member 120 (FIG. 2) resistibly engaging the cam arm 30.

The side wall 14 includes a latch assembly 60 having a base piece 188, a latch cover 66, and protective ribs 196. The protective ribs 196 slidably retain the base piece 188 under the latch cover 66.

Figure 11:
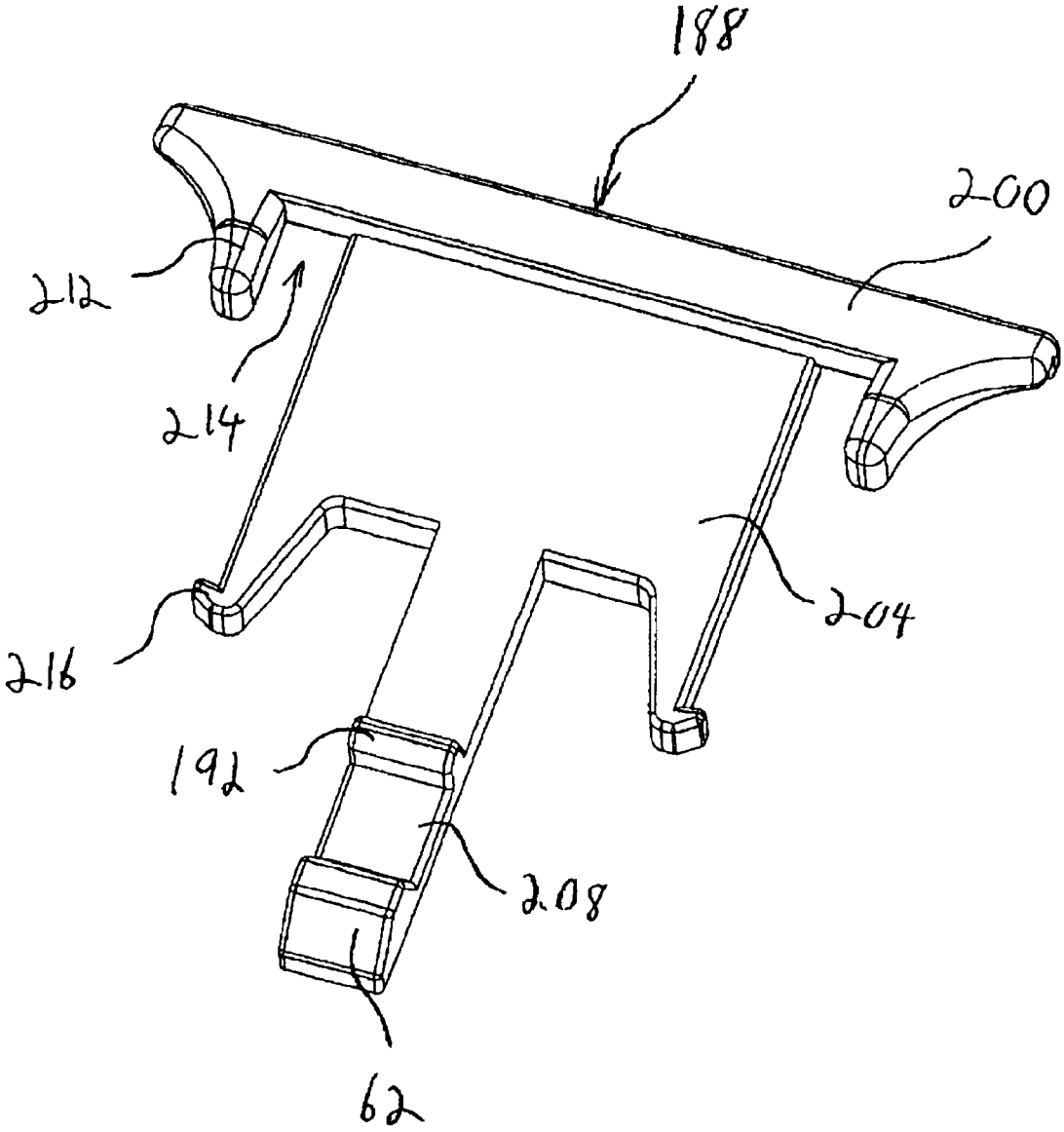
FIG. 11 illustrates an isometric view of a base piece formed according to an embodiment of the present invention.

FIG. 11 illustrates an isometric view of the base piece 188 formed according to an embodiment of the present invention. The base piece 188 includes a catch strip 200 formed integral with a base plate 204, which in turn is formed integral with a latch strip 208. Shoulder gaps 214 extend between the base plate 204 and end fingers 212 of the catch strip 200. The base plate 204 also includes shoulder hooks 216 extending from a side opposite the end fingers 212. The latch strip 208 extends from the base plate 204 between the shoulder hooks 216 and has first and second latches 62 and 192.

Returning to FIG. 3, the base piece 188 is positioned between the protective ribs 196 and the latch cover 66 and onto the side wall 14. The base piece 188 slides between the protective ribs 196 along a longitudinal axis 220. When the latch assembly 60 is in a pre-engagement stage as shown in FIG. 3, the protective ribs 196 engage the shoulder hooks 216 (FIG. 11). When the harness connector 10 is inserted about a shroud 70 (FIG. 2) and the lever member 22 is in the final engaged position, the base piece 188 slides in the direction of arrow D until the protective ribs 196 are retained in the shoulder gaps 214 (FIG. 11) between the base plate 204 (FIG. 11) and the end fingers 212 (FIG. 11). Also a base surface 150 of the lever member 22 is positioned between the first latch 62 and the latch cover 66 in an engagement stage, thus assuring the proper connection of the harness connector 10 and the shroud 70.

Figure 4:
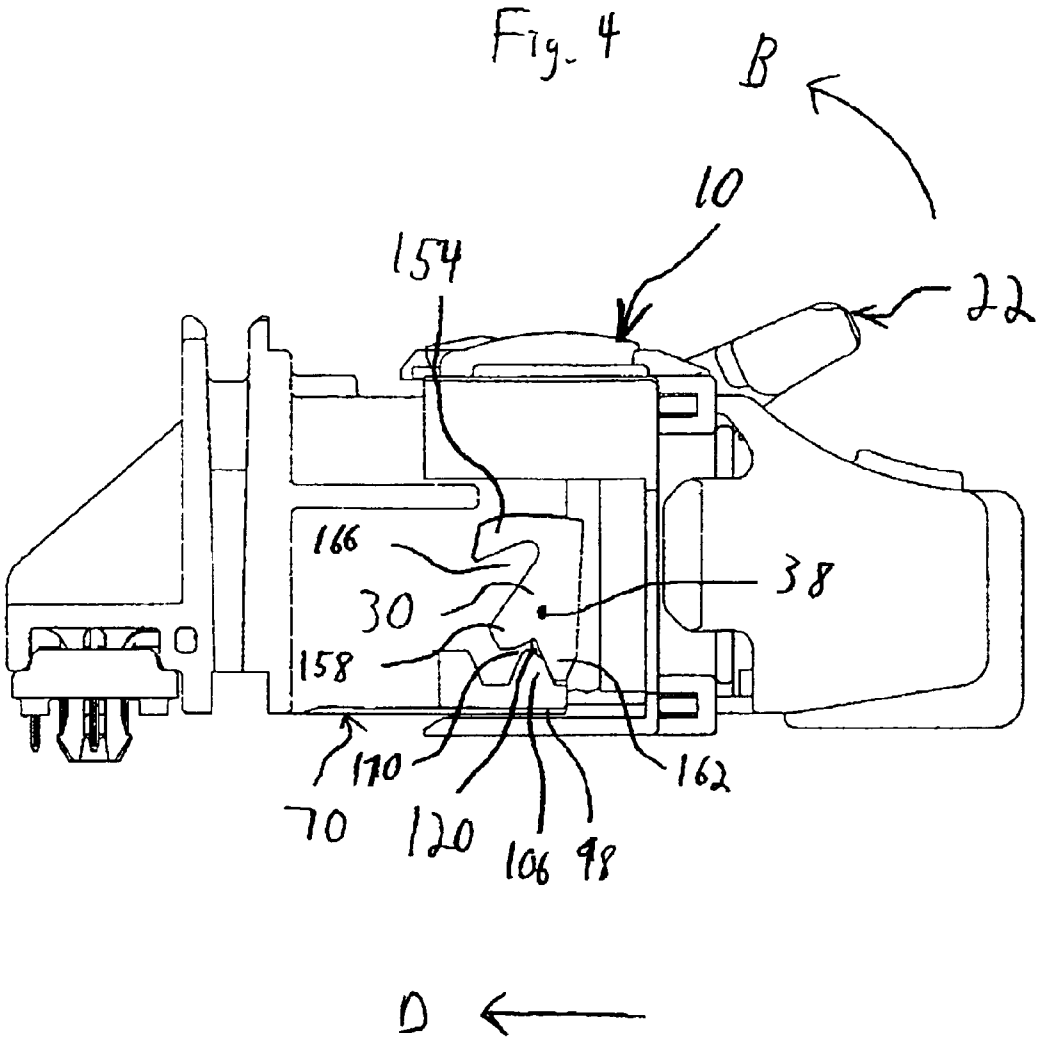
FIG. 4 illustrates a cutaway side view of a harness connector and a shroud in an initial mating position formed according to an embodiment of the present invention.

FIG. 4 illustrates a cutaway side view of the harness connector 10 and the shroud 70 in the initial mating position. The harness connector 10 of FIG. 3 is positioned about a shroud 70. The lever member 22 is in the insertion position, so the cam arm 30 slides over the blocking member 120 without interference. The cam arm 30 includes first, second, and third rack teeth 154, 158, and 162 with the first and second rack teeth 154 and 158 separated by a first notch 166 and the second and third rack teeth 158 and 162 separated by a second notch 170. The third rack tooth 162 engages the first tooth 106 of the rack 98 on the shroud 70. The lever member 22 may now be rotated about the rotational axis 38 in the direction of arrow B to pull the harness connector 10 in the direction of arrow D into the final mating position with the shroud 70 and thus connect the receptacle and plug contacts 74 (FIG. 2).

Figure 5:
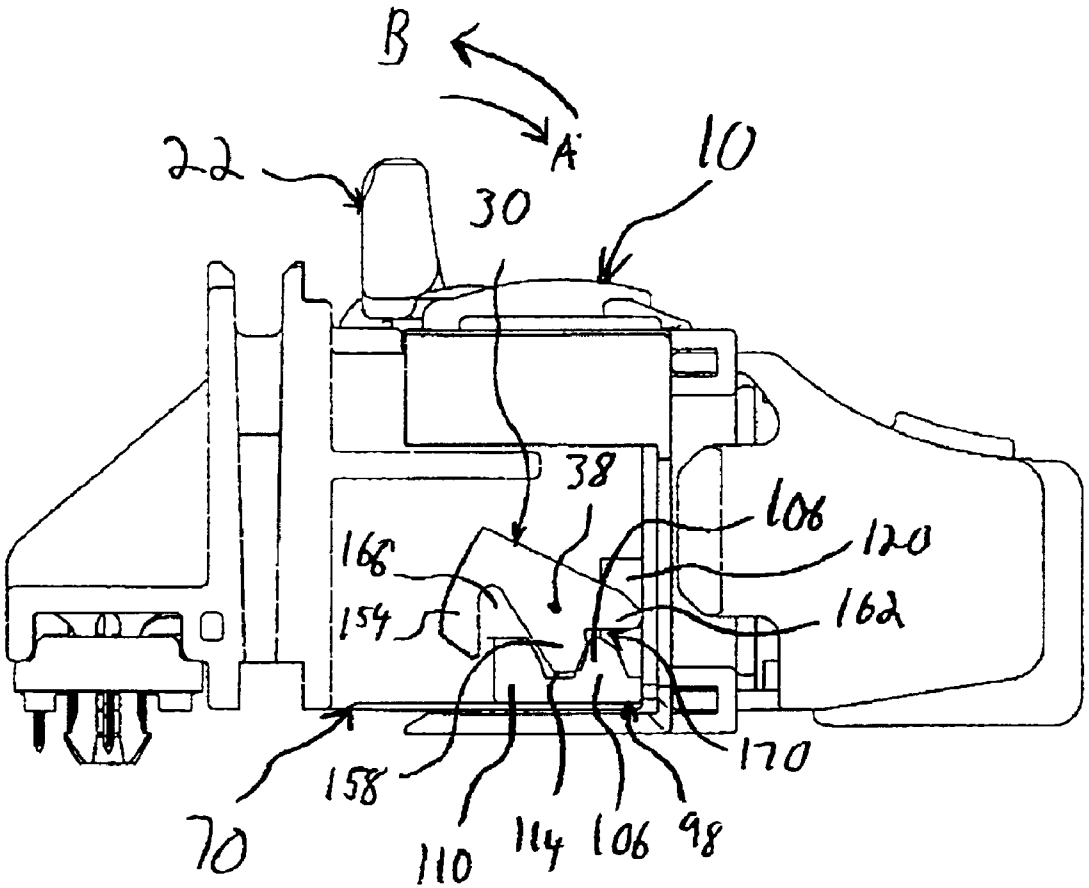
FIG. 5 illustrates a cutaway side view of a harness connector and a shroud in the final mating position formed according to an embodiment of the present invention.

FIG. 5 illustrates a cutaway side view of the harness connector 10 and the shroud 70 in the final mating position. As the lever member 22 is rotated in the direction of arrow B about the rotational axis 38, the second notch 170 pivots about the first tooth 106 of the rack 98 such that the second rack tooth 158 is positioned in the catch gap 114 between the first and second teeth 106 and 110 and the third rack tooth 162 is positioned above the blocking member 120. Additionally, the second tooth 110 is retained in the first notch 166 of the cam arm 30 between the first and second rack teeth 154 and 158. The cam arm 30 and the rack 98 are thus interlocked such that the harness connector 10 is secured about the shroud 70. Alternatively, the harness connector 10 and the shroud 70 are returned to the initial mating position by rotating the lever member 22 about the rotational axis 38 in the direction of arrow A to disengage the cam arm 30 from the rack 98.

Figure 6:
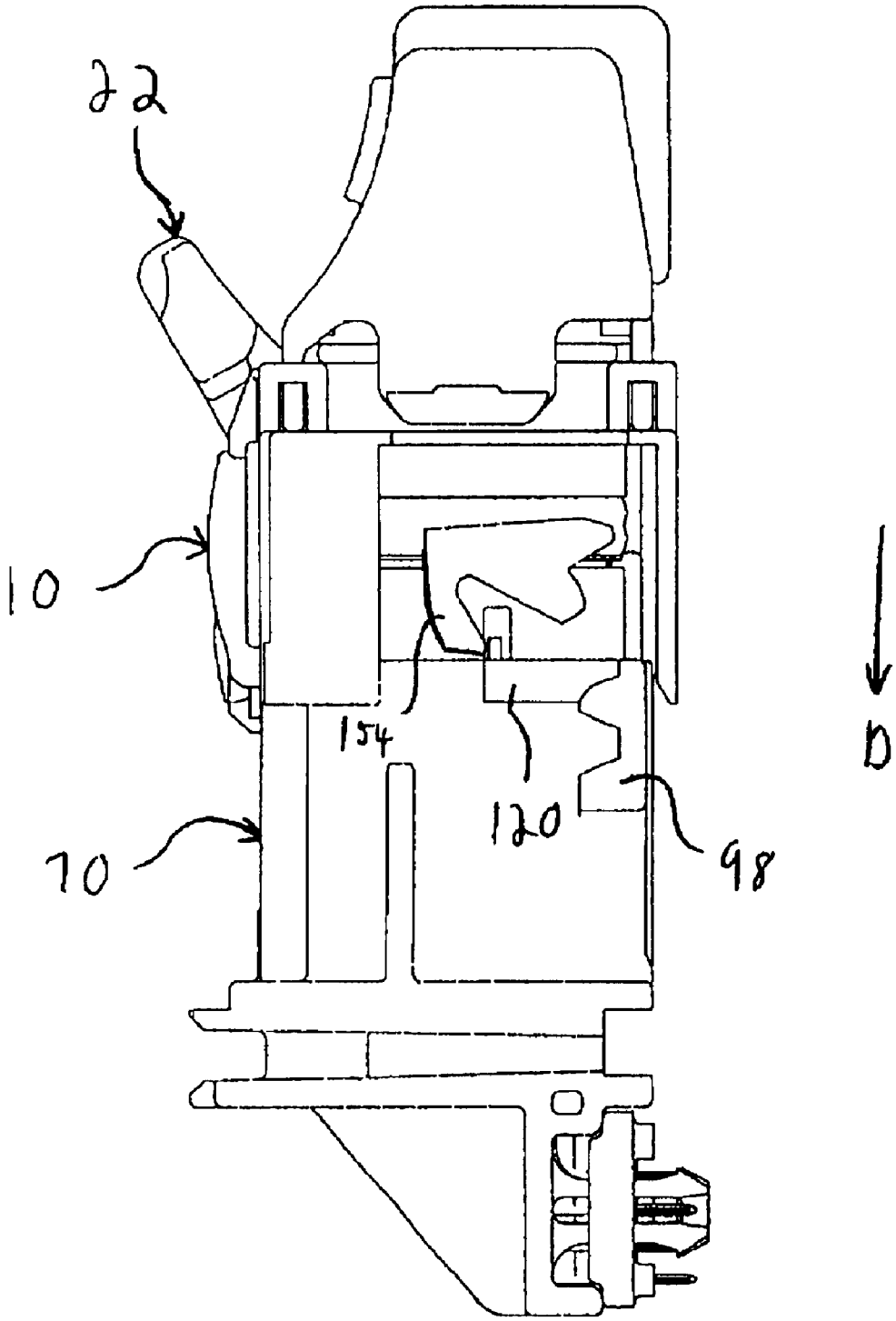
FIG. 6 illustrates a cutaway side view of a harness connector and a shroud in the initial mating position.

FIG. 6 illustrates a cutaway side view of a harness connector 10 and the shroud 70 in the initial mating position. The lever member 22 is not in the insertion position, so the first rack tooth 154 is aligned to engage the blocking member 120. The lever member 22, and thus the harness connector 10, are prevented from proceeding further in the direction of arrow D to engage the rack 98 on the shroud 70.

Figure 7:
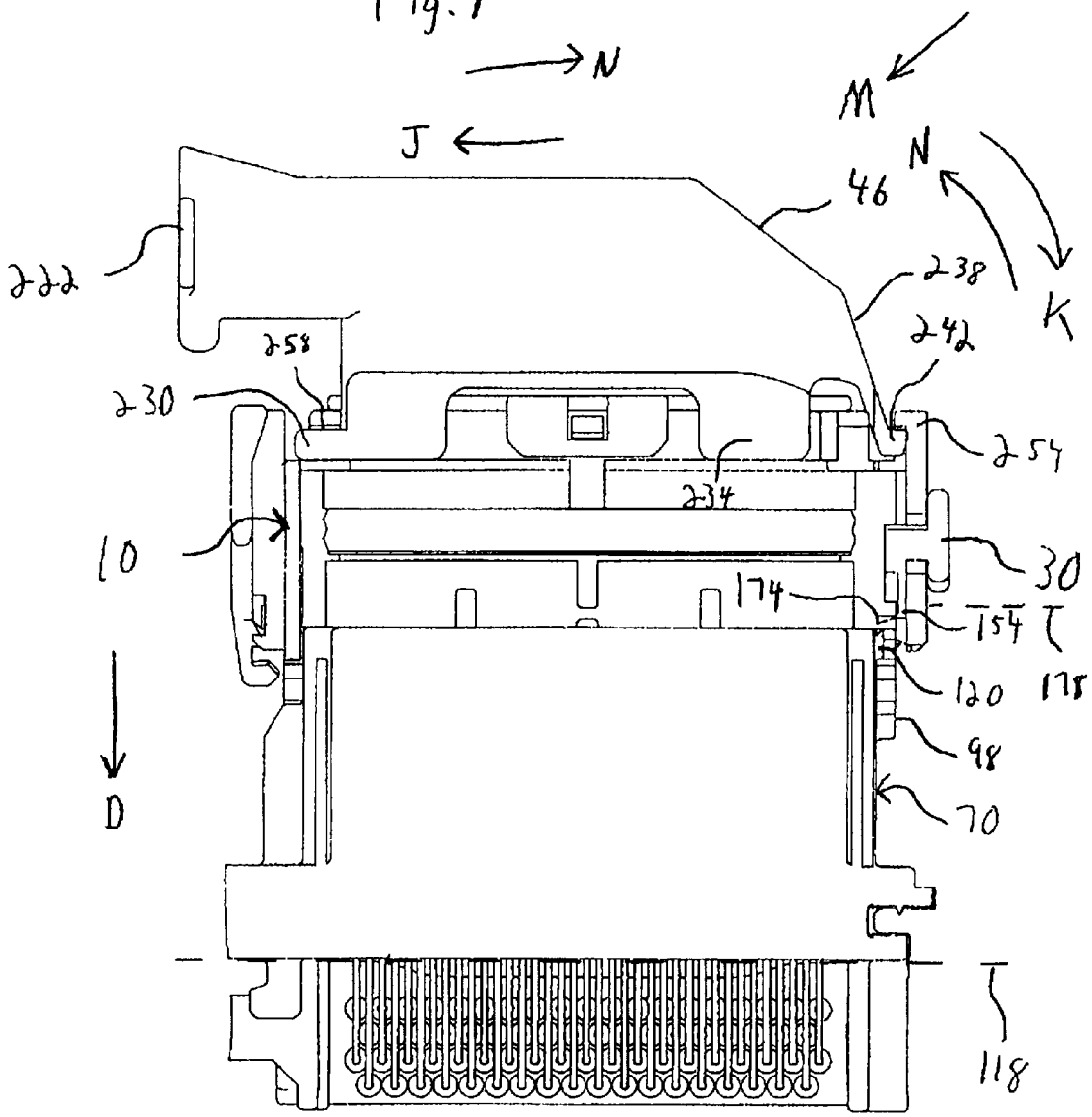
FIG. 7 illustrates a front cutaway view of the harness connector and the shroud in a pre-assembly stage.

FIG. 7 illustrates a front cutaway view of the harness connector 10 and the shroud 70 in a pre-assembly stage. The first rack tooth 154 has a blocking ledge 174 that extends further inward along a longitudinal axis 178 than the rest of the cam arm 30. The blocking ledge 174 is resisted by the blocking member 120 on the shroud 70 such that the cam arm 30 is prevented from engaging the rack 98 on the shroud 70. The blocking member 120 and the blocking ledge 174 interact to prevent the harness connector 10 from being inserted about the shroud 70 when the lever member 22 is not in the insertion position. If the lever member 22 is not in the insertion position when the harness connector 10 and the shroud 70 are in the initial mating position, the cam arm 30 and the rack 98 may not properly engage as the lever member 22 is rotated to the final engaged position (FIG. 1).

Figure 8:
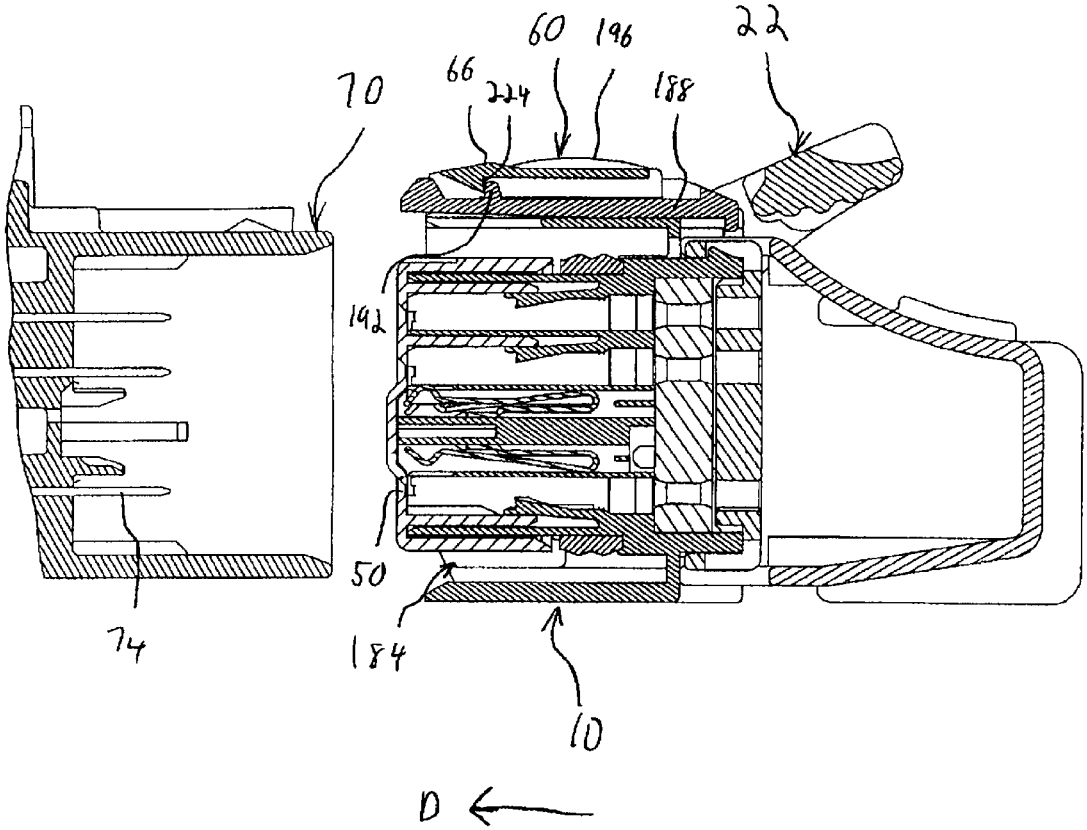
FIG. 8 illustrates a side sectional view of a harness connector and a shroud in the pre-assembly stage.

FIG. 8 illustrates a side sectional view of a harness connector 10 and a shroud 70 in the pre-assembly stage. The lever member 22 is in the insertion position and the latch assembly 60 is in the pre-engagement stage. As shown, the base piece 188 is positioned within the protective ribs 196 underneath the latch cover 66, while the second latch 192 engages a ledge 224 extending from the latch cover 66. The harness connector 10 is inserted about the shroud 70 in the direction of arrow D such that the shroud 70 is received within the shroud gap 184 and the plug contacts 74 are received in the receptacle cavities 50.

Figure 9:
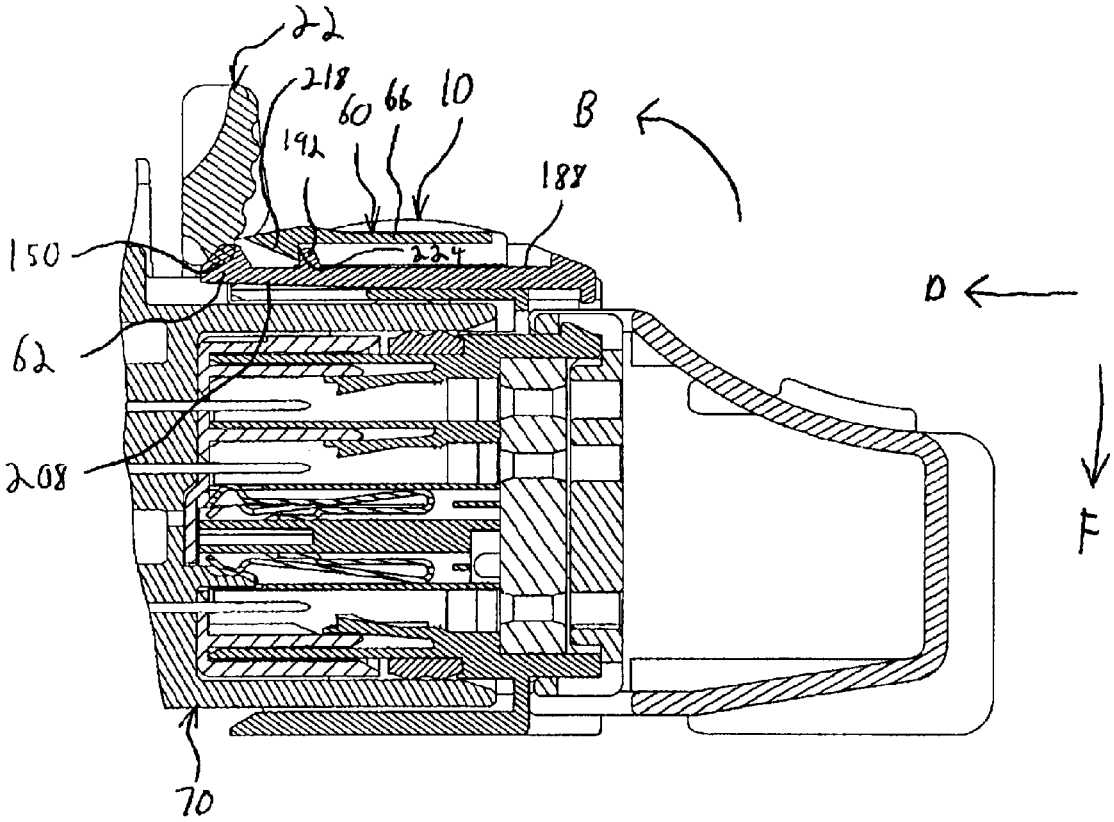
FIG. 9 illustrates a side sectional view of the harness connector and shroud of FIG. 8 in the final mating position.

FIG. 9 illustrates a side sectional view of the harness connector 10 and shroud 70 of FIG. 8 in the final mating position. After the harness connector 10 and the shroud 70 are in the initial mating position, the lever member 22 is rotated about the rotational axis 38 (FIG. 1) in the direction of arrow B to move the harness connector 10 into the final mating position. When the lever member 22 is rotated up over the latch assembly 60 into the final engaged position, the base surface 150 engages and manually pushes the first latch 62, and thus the entire latch strip 208, downward in the direction of arrow F such that the second latch 192 becomes disengaged from the ledge 224, shown in FIG. 10. The base piece 188 is then slid in the direction of arrow D with the second latch 192 sliding along an inclined surface 218 of the latch cover 66 and the protective ribs 196 (FIG. 3) being received in the shoulder gaps 214 (FIG. 11). As the second latch 192 slides along the inclined surface 218 in the direction of arrow D, the base surface 150 of the lever member 22 slides between the first latch 62 and the latch cover 66.

Figure 10:
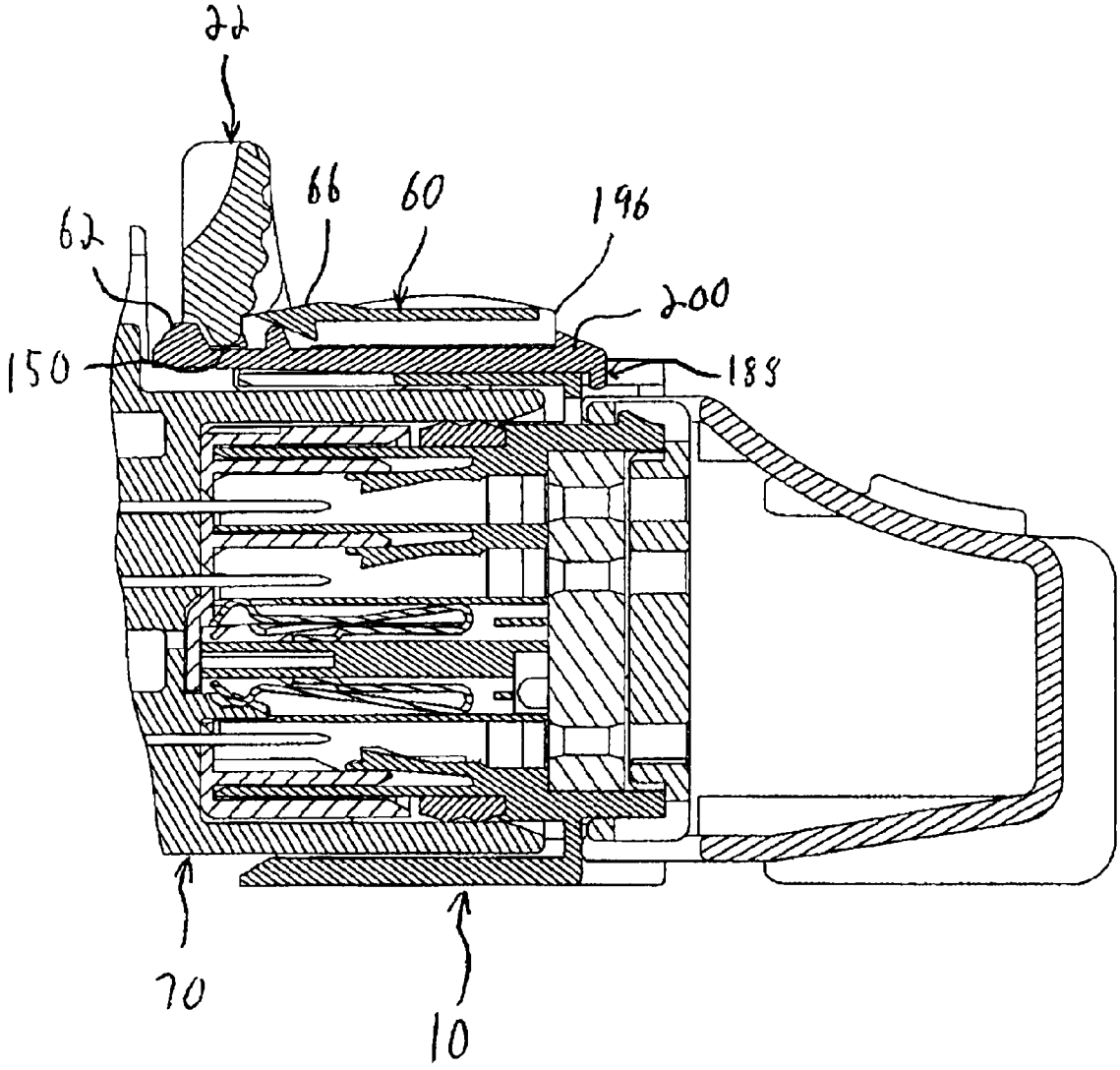
FIG. 10 illustrates a side sectional view taken along line 11—11 in FIG. 1 of the harness connector and shroud in the final mating position with the latch assembly in the engagement stage with the lever member.

FIG. 10 illustrates a side sectional view taken along line 11—11 of FIG. 1 of the harness connector 10 and shroud 70 in the final mating position with the latch assembly 60 in the engagement stage with the lever member 22. As shown, the base surface 150 of the lever member 22 is positioned between the first latch 62 and the latch cover 66 and the catch strip 200 of the base piece 188 fully engages the protective ribs 196. When the latch assembly 60 is in the engagement stage, the lever member 22 has been rotated to the final engaged position to fully connect the harness connector 10 and the shroud 70. Thus, the latch assembly 60 in the engagement stage indicates to an operator that the harness connector 10 is fully connected with the shroud 70 such that the plug contacts 74 (FIG. 2) fully engage the receptacle contacts.

Figure 12:
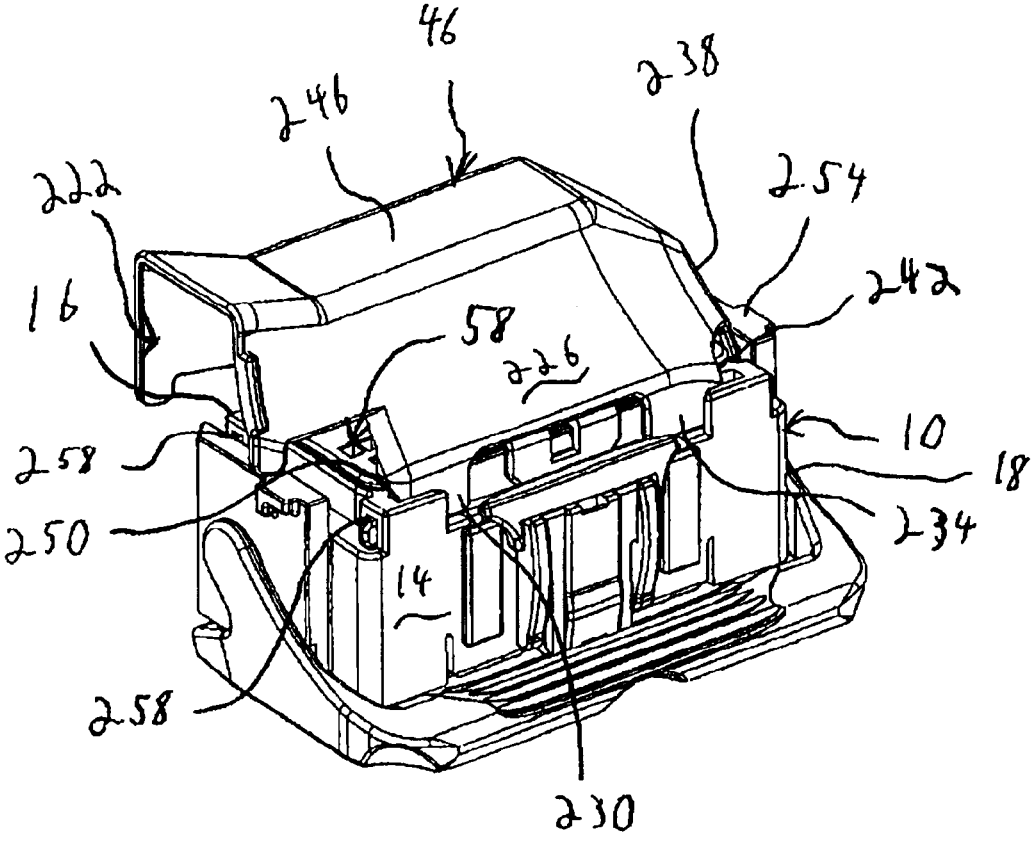
FIG. 12 illustrates an isometric view of a harness connector formed in accordance with an embodiment of the present invention.

FIG. 12 illustrates an isometric view of the harness connector 10 formed in accordance with an embodiment of the present invention. The harness connector 10 includes a wire shield 46 made of a flexible material and defined by opposite side walls 226 formed with a top wall 246 and a rear wall 238. The wire shield 46 has a front end 222 that receives wires that are connected to the receptacle contacts within the harness connector 10. The side walls 226 have feet 230 and beams 234, and the rear wall 238 has a tab 242. The feet 230, beams 234, and the tab 242 are received within the harness connector 10 to hold the wire shield 46 about the reception end 58 of the harness connector 10.

The harness connector 10 has slots 250 formed along the side walls 14 and 16 at the reception end 58. The slots 250 at one end of the harness connector 10 have apertures 258 that receive the feet 230 of the wire shield 46 while the slots 250 at an opposite end are closed and receive the beams 234 of the wire shield 46. The end wall 18 proximate the rear wall 238 of the wire shield 46 has a catch 254 that receives the tab 242 (FIG. 7) of the wire shield 46.

FIG. 7 better illustrates the interaction of the catch 254 and the tab 242. As shown, the catch 254 is L-shaped and extends over the tab 242 to resistibly hold the wire shield 46 to the harness connector 10 when the feet 230 and beams 234 are in the slots 250 (FIG. 12). The wire shield 46 is attached to the harness connector 10 by sliding the front end 222 of the wire shield 46 toward the slots 250 with the apertures 258 in the direction of arrow J such that the feet 230 are caught within the slots 250 and extend through the apertures 258. The wire shield 46 is then lowered arcuately in the direction of arrow K with the feet 230 pivoting within the apertures 258 until the beams 234 enter the slots 250 and the tab 242 engages the catch 254. The rear wall 238 is then biased in the direction of arrow M such that the tab 242 slides past and under the catch 254 and the wire shield 46 is secured to the harness connector 10. The wire shield 46 is removed from the harness connector 10 by again biasing the rear wall 238 in the direction of arrow M and rotating the wire shield 46 upward in the direction of arrow N about the feet 230 until the tab 242 no longer engages the catch 254. The feet 230 are then removed from the slots 250, and the wire shield 46 may be removed from the harness connector 10. Thus, the wire shield 46 is easily connected to, and removed from, the harness connector 10 without the use of any tooling.

Returning to FIG. 3, the lever member 22 is in the insertion position about the harness connector 10. The harness connector 10 includes a locking member having a catch 262 and recess wall 274 situated along a top end of the end wall 18. The release arm 130 has a boss 266 and an L-shaped release foot 270 separated by a gap 282. The catch 262 receives the boss 266 such that the release foot 270 is situated in front of the end wall 18 with the recess wall 274 extending into the gap 282. With the boss 266 in the catch 262 engaging the recess wall 274 opposite the release foot 270, the lever member 22 is prevented from being rotated about the rotational axis 38 in the direction of arrow B. The catch 262 thus retains the boss 266 to prevent the lever member 22 from escaping the insertion position.

Figure 13:
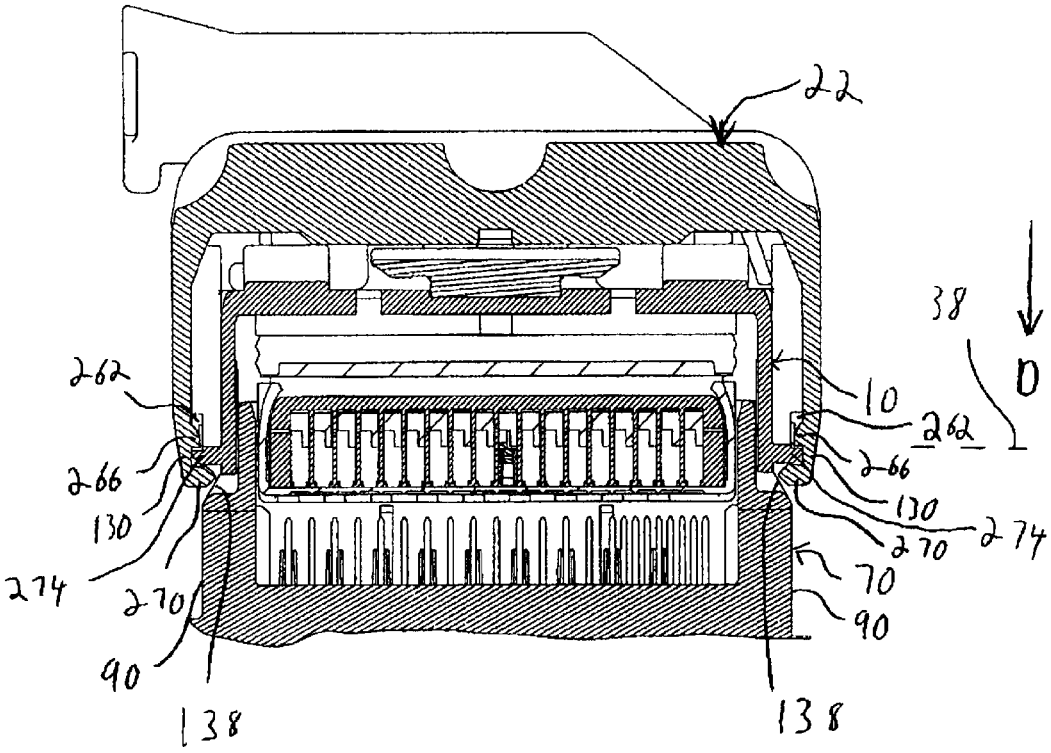
FIG. 13 illustrates a cutaway top view of a harness connector positioned about a shroud formed according to an embodiment of the present invention.

FIG. 13 illustrates a cutaway top view of the harness connector 10 positioned about the shroud 70. The bosses 266 extending from the release arms 130 are retained within the catches 262 and the release feet 270 are proximate the sloped release members 138 on the side walls 90 of the shroud 70. As the harness connector 10 is positioned further in the direction of arrow D onto the shroud 70, the release feet 270 engage the release members 138 such that the release feet 270, and thus the release arms 130, are pushed outward away from each other and the bosses 266 are lifted out of the catches 262. With the recess walls 274 no longer engaging the release feet 270 and the bosses 266, the lever member 22 may be rotated about the rotational axis 38. Thus, the catches 262 retain the bosses 266 to maintain the lever member 22 in the insertion position until the harness connector 10 is inserted on the shroud 70 into the initial mating position. The lever member 22 is thus properly aligned with the racks 98 (FIG. 2) on the shroud 70 to move the harness connector 10 into the final mating position when rotated to the final engaged position.

Figure 14:
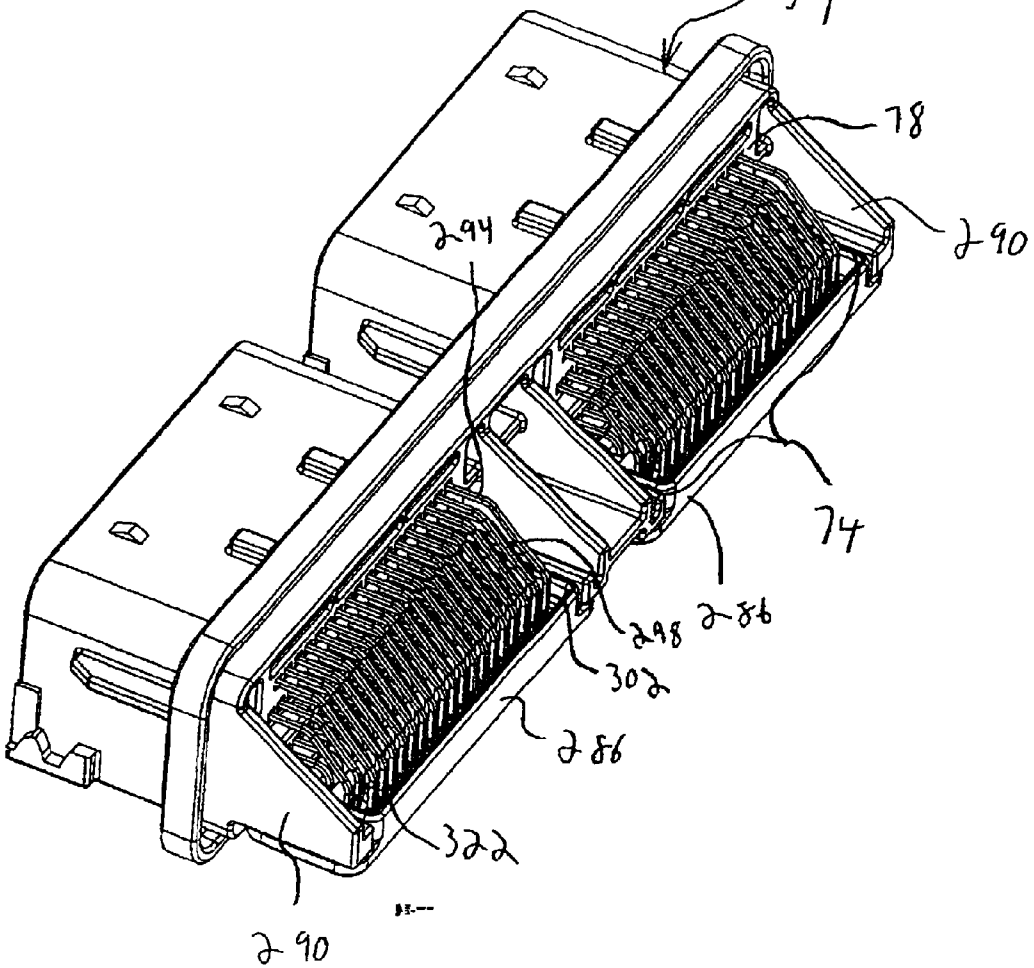
FIG. 14 illustrates a rear isometric view of the header connector of FIG. 2.

FIG. 14 illustrates a rear isometric view of the header connector 54 of FIG. 2. The plug contacts 74 extend from the rear wall 78 of the header connector 54 to templates 286 connected to the rear wall 78 by triangular template supports 290. Each plug contact 74 has a horizontal top portion 294 extending from the rear wall 78 formed with an angled intermediary portion 298 which in turn is formed with a vertical bottom portion 302 perpendicular to the top portion 294. The bottom portions 302 have tail ends 306 (FIG. 16) that extend through the templates 286 to be connected to a printed circuit board (not shown). The bottom portions 302 also have retention features 322. In operation, the templates 286 are filled with an epoxy (not shown) to cover the retention features 322 of the bottom portions 302 and allowed to dry. The retention features 322 engage the solid epoxy such that the plug contacts 74 are firmly stabilized and retained within the templates 286. Because the bottom portions 302 are stabilized within the templates 286, tail ends 306 (FIG. 16) may be press fit into apertures within the printed circuit board without being bent or buckled.

Figure 15:
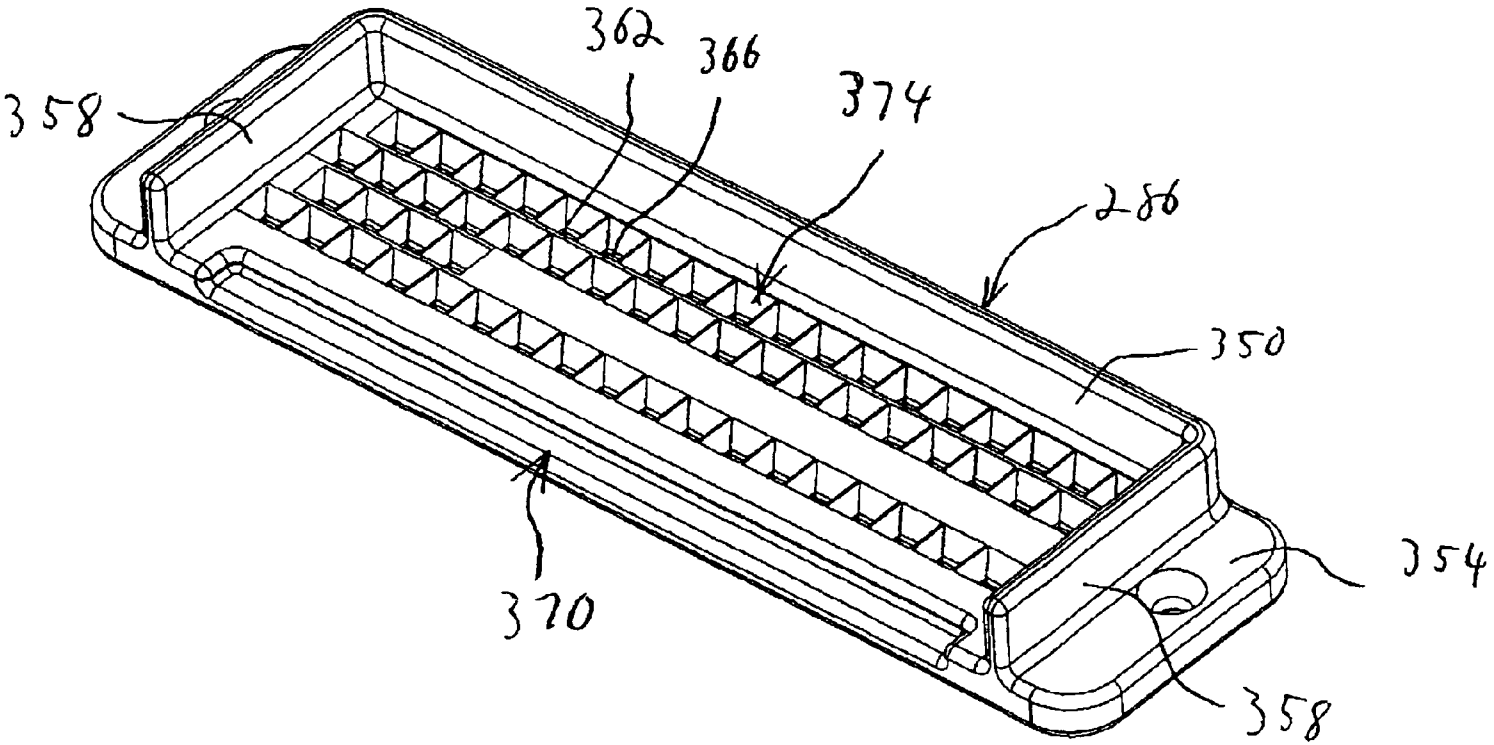
FIG. 15 illustrates an isometric view of a template formed according to an embodiment of the present invention.

FIG. 15 illustrates an isometric view of the template 286 formed according to an embodiment of the present invention. The template 286 has a side wall 350 opposite an open end 370 and formed with opposite end walls 358. The side wall 350 and the end walls 358 extend from a base 354 and define an open chamber 374. The template 286 includes pockets 362 that receive the bottom portions 302 (FIG. 14) of the plug contacts 74 (FIG. 14). The pockets 362 enclose apertures 366 that extend through the base 354. The template 286 is connected to the rear wall 78 (FIG. 14) of the header connector 54 (FIG. 14) to receive the plug contacts 74 in the pockets 362 with the tail ends 306 (FIG. 16) extending through the apertures 366. The end walls 358 are positioned between the template supports 290 (FIG. 14) and the base 354 at the open end 370 engages the rear wall 78 such that the rear wall 78 encloses the chamber 374 to receive the epoxy.

Figure 16:
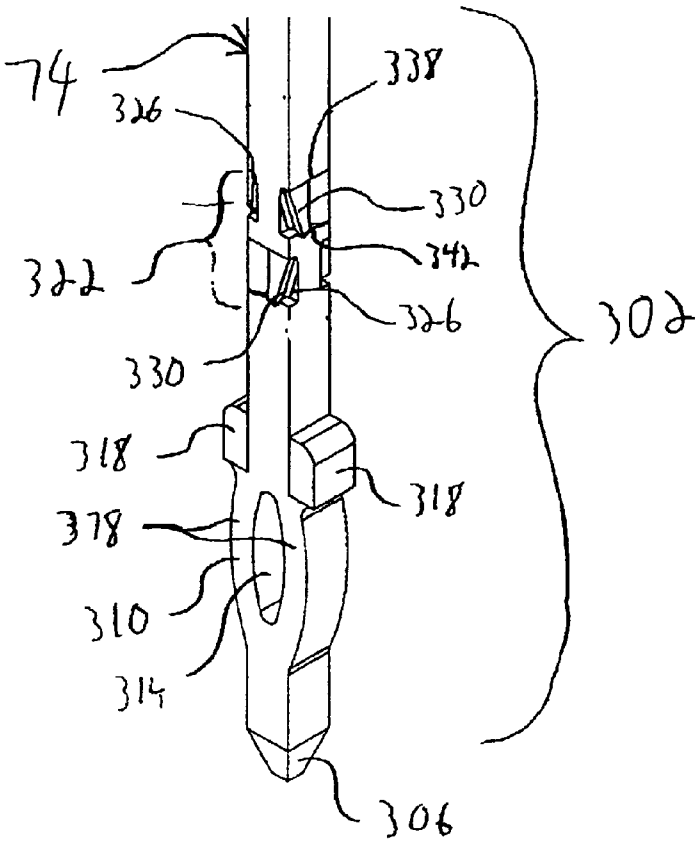
FIG. 16 illustrates an isometric view of a bottom portion of a plug contact formed according to an embodiment of the present invention.

FIG. 16 illustrates an isometric view of a bottom portion 302 of a plug contact 74. The bottom portion 302 includes the tail end 306 that extends to an eye 310 that is wider than the tail end 306 and that includes side walls 378 surrounding a hollowed core 314. Template catches 318 extend opposite each other on the bottom portion 302 between the eye 310 and the retention feature 322. The retention feature 322 includes recesses 326 aligned opposite each other and paired with each pair on alternating sides of the bottom portion 302. Each recess 326 includes barbs 330 extending outward from the recess 326 beyond a plane of each side of the bottom portion 302 at an angle to the plane. The barbs 330 extend inward from a top wall 338 of the recess 326 to a bottom wall 342 of the recess 326.

In operation, when the bottom portions 302 are received in the template 286 (FIG. 15), the tail ends 306 and the eyes 310 extend through the apertures 366 (FIG. 15) with the template catches 318 resistibly engaging the pockets 362 (FIG. 15) to prevent the bottom portions 302 from being further inserted through the apertures 366. The retention features 322 are positioned within the chamber 374 (FIG. 15) of the template 286 and are covered by the epoxy. The epoxy enters the recesses 326 of the retention features 322 and solidifies within the recesses 326 and about the angled barbs 330. The solidified epoxy thus frictionally engages the barbs 330 to hold the bottom portions 302 firmly stabilized within the chamber 374. The tail ends 306 and eyes 310 are then inserted into the apertures in the printed circuit board.

The apertures are generally dimensioned to receive the tail ends 306. Because the eyes 310 are larger than the tail ends 306, each eye 310 is resistibly inserted into one of the apertures such that the side walls 378 are biased inward toward each other into the core 314. Once the eyes 310 are held within the apertures in the printed circuit boards, the side walls 378 push outward away from each other against aperture walls in the printed circuit board. The epoxy holds the barbs 330 to stabilize the bottom portions 302 as the eyes 310 are press fit into the apertures. Thus, the plug contacts 74 do not buckle or become displaced when connected to the printed circuit board.

Figure 17:
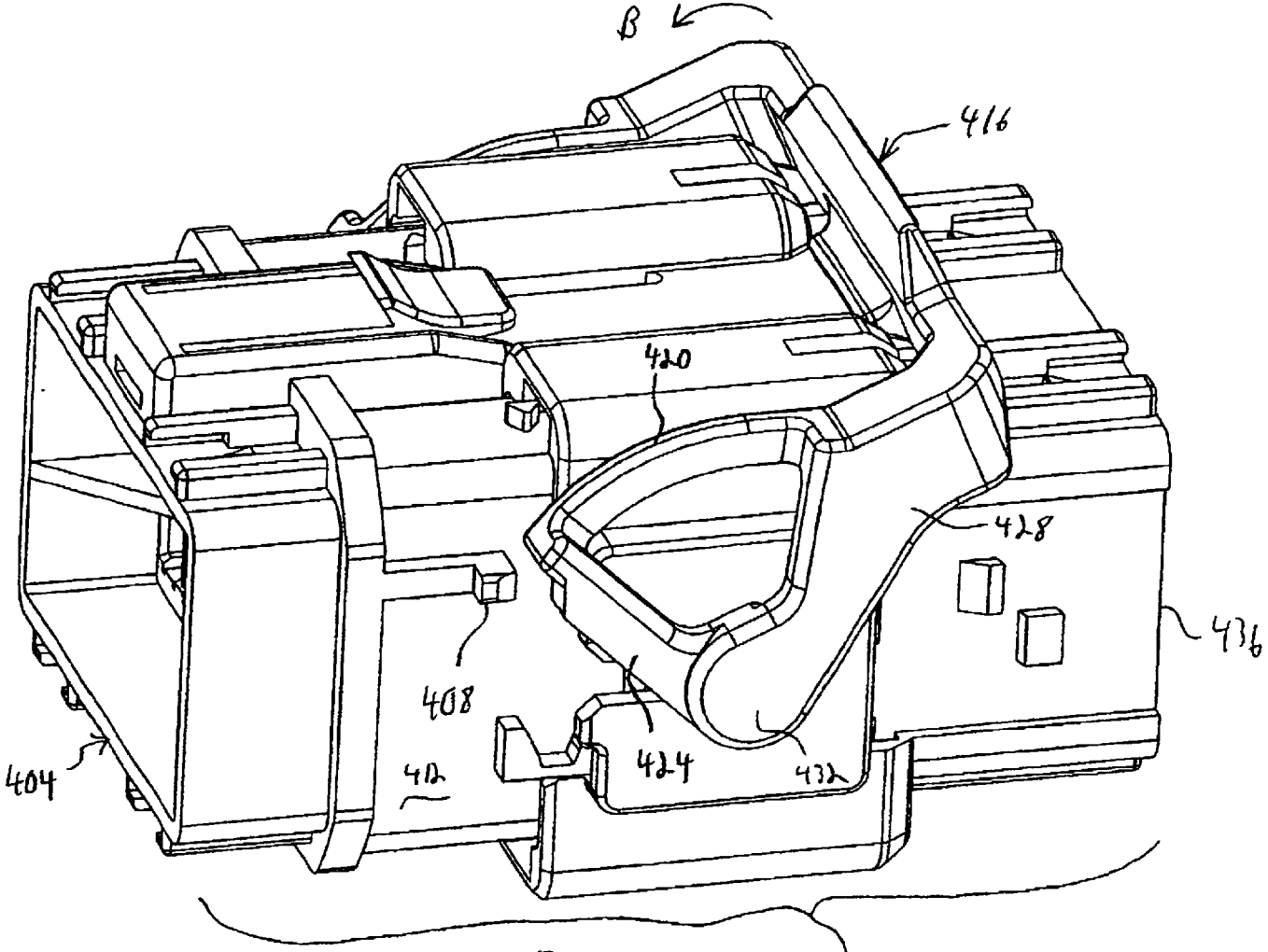
FIG. 17 illustrates an isometric view a mate assist assembly formed according to an alternative embodiment of the present invention.

FIG. 17 illustrates an isometric view of a mate assist assembly 400 formed according to an alternative embodiment of the present invention. The header connector 404 has a rectangular blocking member 408 extending outward from each end wall 412. The lever member 416 includes resistance beams 420 and support beams 424. The resistance beams 420 are arc-shaped and extend from the lever arms 428 to the support beams 424. The support beams 424 extend at an acute angle from the cam arms 432 to join with the resistance beams 420. The lever member 416 is shown in FIG. 17 to be in the insertion position. When the lever member 416 is not in the insertion position, the resistance beams 420 are rotated forward in the direction of arrow B to a position at which the resistance beams 420 resistibly engage the blocking members 408 and prevent the header connector 404 and the harness connector 436 from being joined in the initial mating position.

Figure 18:
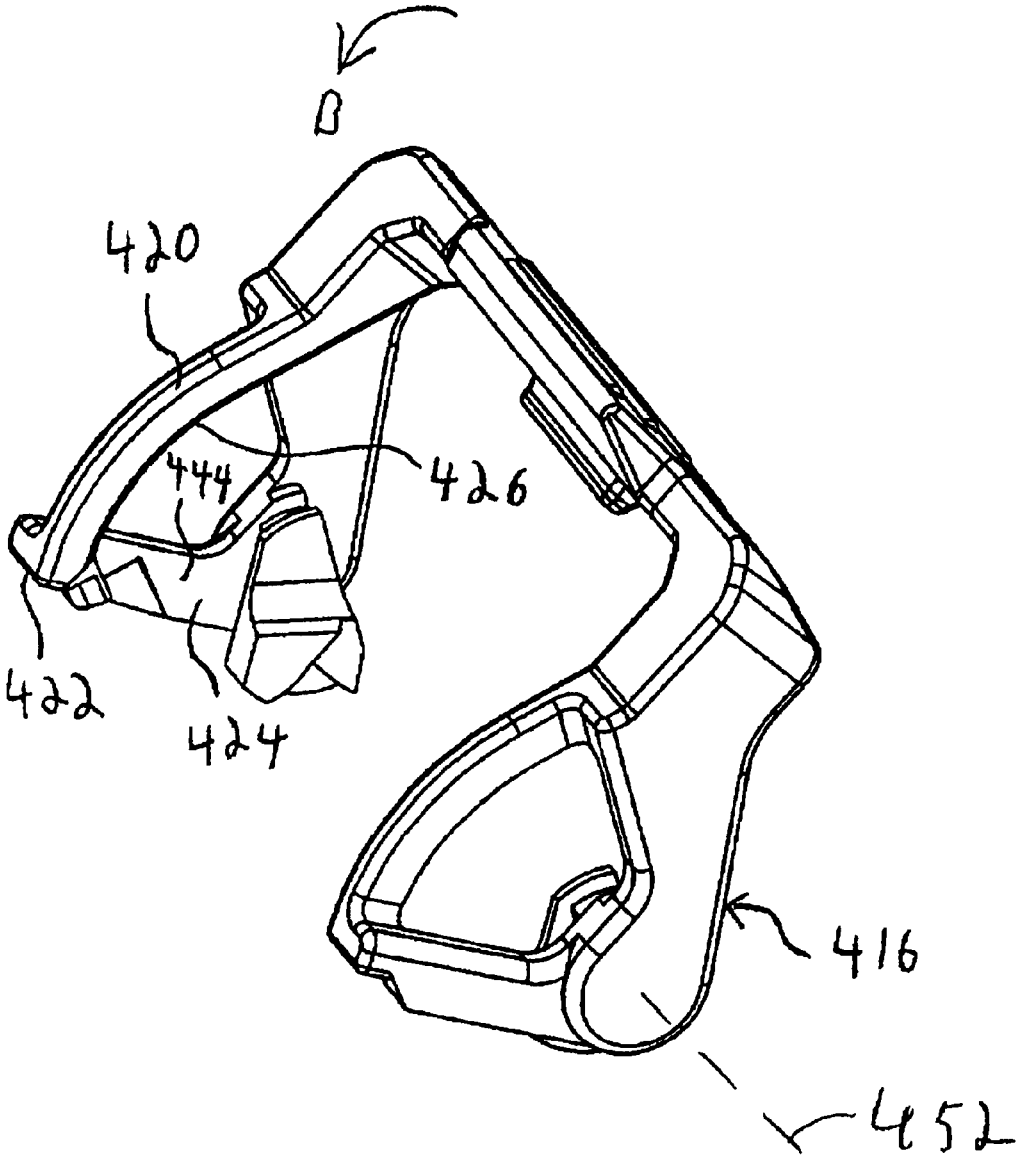
FIG. 18 illustrates an isometric view of the lever member formed according to an alternative embodiment of the present invention.

FIG. 18 illustrates an isometric view of the lever member 416 formed according to an embodiment of the present invention. The resistance beams 420 have inner radial surfaces 426 and flat contact surfaces 422 that extend outward away from each other to intersect the support beams 424. Thus, support beams 424 are separated further from each other along the rotational axis 452 than the resistance beams 420. Therefore, inner surfaces 444 of the support beams 424 slide along the end walls 456 (FIG. 19) of the harness connector 436 (FIG. 19) and over the blocking members 408 (FIG. 17) of the header connector 404 (FIG. 17) as the lever member 416 is rotated in the direction of arrow B about the rotational axis 452. However, because the resistance beams 420 are closer together along the rotational axis 452 than the support beams 424, the contact surfaces 422 of the resistance beams 420 engage the blocking members 408 on the header connector 404 when the lever member 416 is out of the insertion position in the direction of arrow B.

Figure 19:
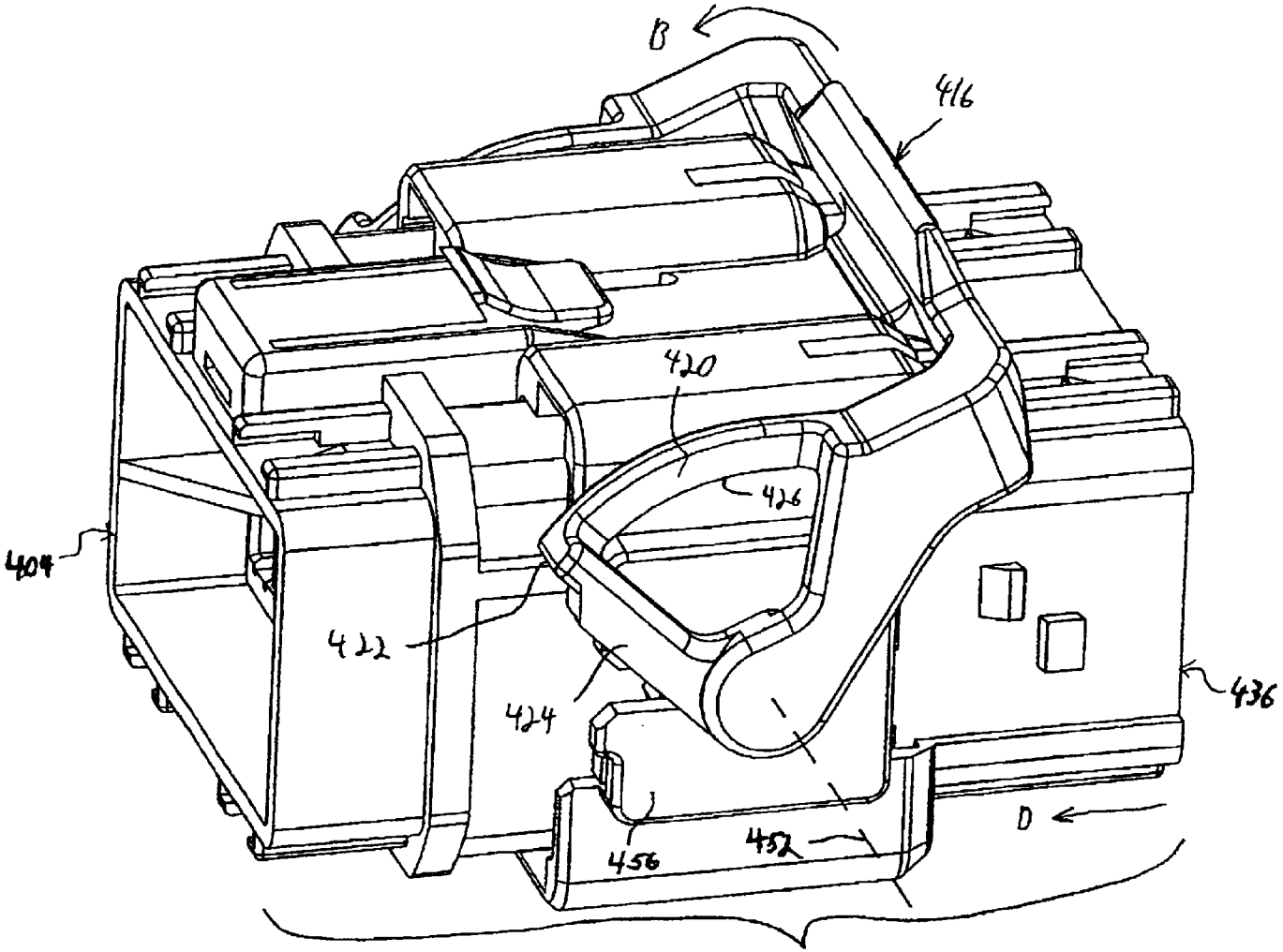
FIG. 19 illustrates an isometric view of the mate assist assembly in an initial mating position formed according to an alternative embodiment of the present invention.

FIG. 19 illustrates an isometric view of the mate assist assembly 400 in an initial mating position formed according to an embodiment of the present invention. Because the lever member 416 is in the insertion position, the harness connector 436 has been positioned in the direction of arrow D such that the blocking members 408 (FIG. 17) have slid along the inner surfaces 444 (FIG. 18) of the support beams 424 without engaging the contact surfaces 422 of the resistance beams 420. Because the inner radial surfaces 426 of the resistance beams 420 are arced, as the lever member 416 is rotated in the direction of arrow B about the rotational axis 452, the inner radial surfaces 426 rotate around, and do not engage, the blocking members 408 which are initially positioned alongside the inner surfaces 444 (FIG. 18) of the support beams 424. As the lever member 416 is further rotated in the direction of arrow B about the rotational axis 452, the harness connector 436 slides in the direction of arrow D toward the final mating position with the header connector 404 and the blocking members 408 slide completely past the inner surfaces 444 of the support beams 424 toward the end walls 456 of the harness connector 436.

Figure 20:
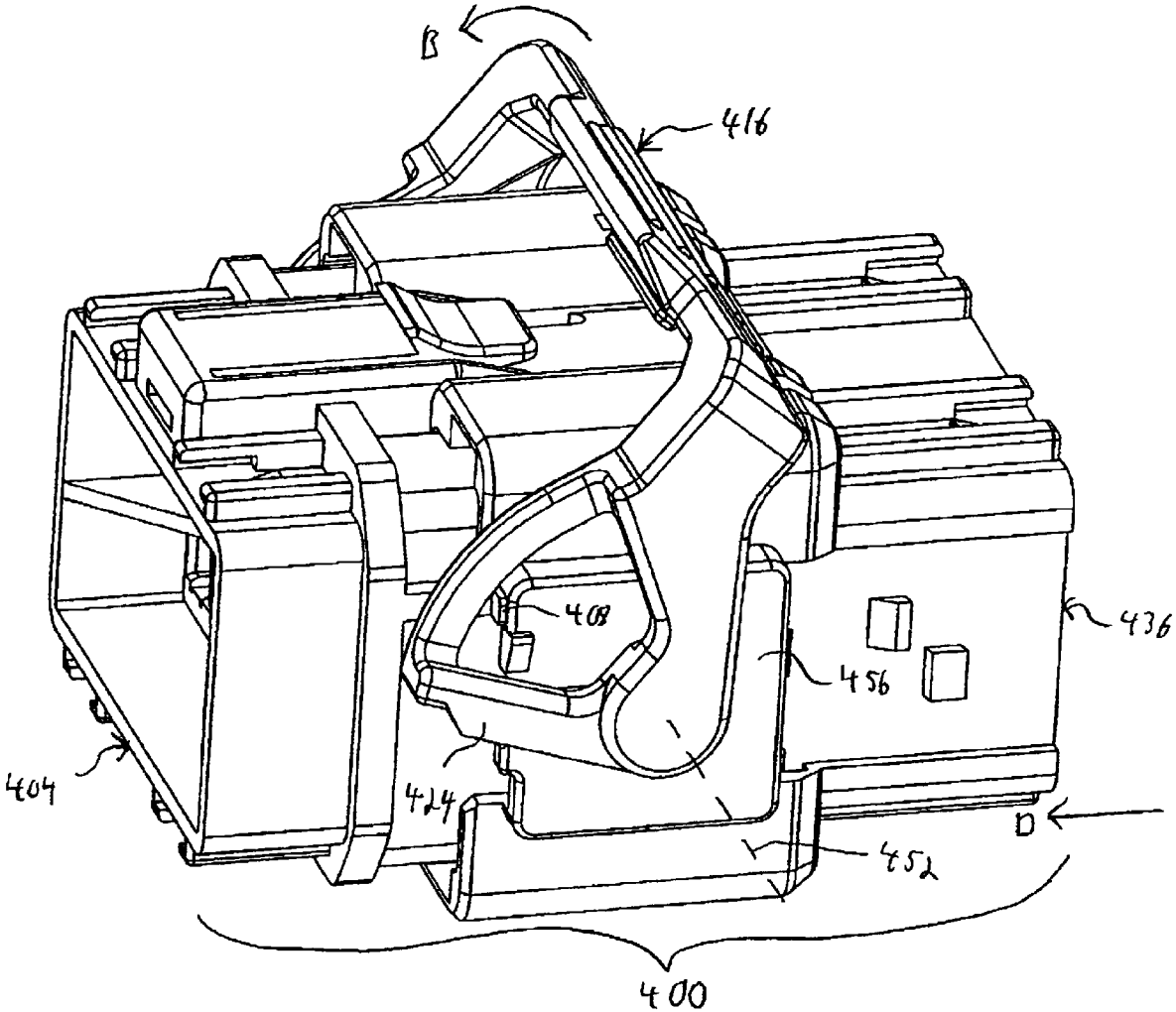
FIG. 20 illustrates an isometric view of the mate assist assembly formed according to an alternative embodiment of the present invention.

FIG. 20 illustrates an isometric view of the mate assist assembly 400 formed according to an embodiment of the present invention. The lever member 416, of FIG. 20, is located at an intermediary position during rotation from the insertion position to the final engaged position in the direction of arrow B about the rotational axis 452. As the lever member 416 is rotated in the direction of arrow B, the harness connector 436 moves in the direction of arrow D such that the blocking members 408 slide completely past the inner surfaces 444 (FIG. 18) of the support beams 424 and are received within the end walls 456 of the harness connector 436. Thus, the lever member 416 may be fully rotated to the final engaged position to join the harness and header connectors 436 and 404 in the final mating position.

Figure 21:
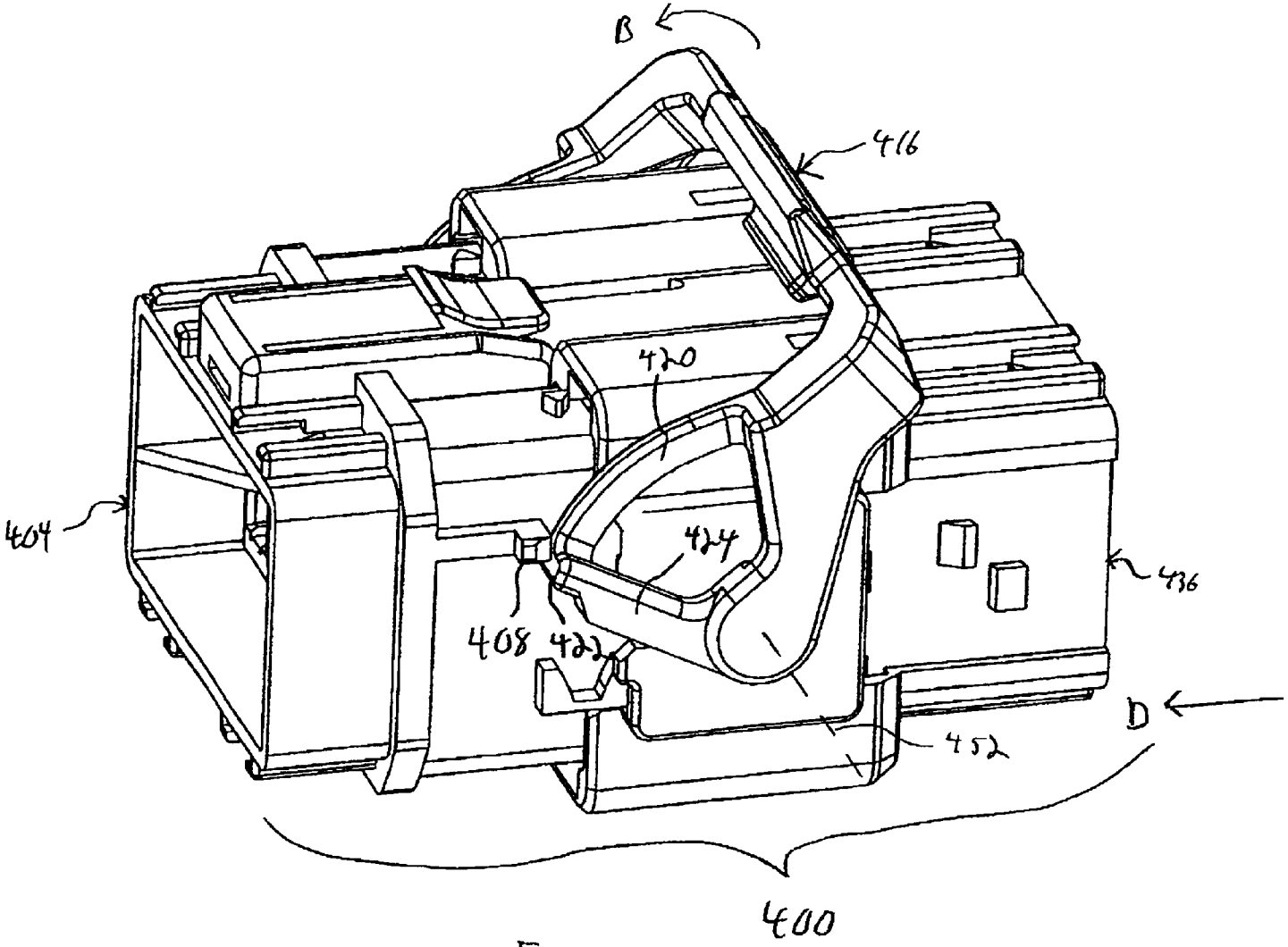
FIG. 21 illustrates an isometric view of the mate assist assembly formed according to an alternative embodiment of the present invention.

FIG. 21 illustrates an isometric view of the mate assist assembly 400 formed according to an embodiment of the present invention. The lever member 416 is rotated out of the insertion position about the rotational axis 452 by a few degrees in the direction of arrow B before the header and harness connectors 404 and 436 have been joined in the initial mating position. Therefore, when the harness connector 436 is pushed in the direction of arrow D onto the header connector 404, the blocking members 408 resistibly engage the contact surfaces 422 of the resistance beams 420. Therefore, the header and harness connectors 404 and 436 are prevented from being joined in the initial mating position and cannot be fully connected to the final mating position. Therefore, the resistance beams 420 and the support beams 424 prevent the header and harness connectors 404 and 436 from being joined unless the lever member 416 is properly oriented to engage the header and harness connectors 404 and 436.

The electrical connector assembly of the different embodiments confers several benefits. First, the catch and boss on the harness connector and the lever member, respectively, engage each other to maintain the lever member in the insertion position when the harness connector is separated from the header connector. Thus, an operator may be sure that the lever member is properly aligned in the insertion position whenever the harness connector is positioned on a shroud in the initial mating position.

Second, the shroud includes the blocking member that engages the cam arm of the lever member when the harness connector is inserted about the shroud into the initial mating position with the lever member out of the insertion position. Because the lever member needs to be in the insertion position for the cam arms to properly engage the racks when the harness connector and shroud are in the initial mating position, the blocking member assures an operator that the cam arms fully engage the racks as the lever member is rotated to the final engaged position.

Third, the latch assembly engages the lever member when the lever member is in the final engaged position such that the base piece slides into the engagement position that assures an operator that the lever member has been fully rotated to connect the harness connector and shroud.

Fourth, the wire shield is easily connected to, and removed from, the harness connector without the use of special tooling because the feet and tabs that are slidably received within the slots on the harness connector and the tab releasably engages the catch on the harness connector.

Finally, the electrical contacts extending from the header connector have retention features that are firmly held in an epoxy such that the tail ends and eyes of the electrical contacts are inserted into the printed circuit board with out buckling. Thus, special tooling is not needed to connect the electrical contacts to the printed circuit board, and the electrical contacts may be closely aligned within the epoxy.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. An electrical connector assembly comprising:

first and second housings having ends configured to receive electrical contacts, said first and second housings being configured to be matable with one another to join corresponding electrical contacts;

a lever member including a cam arm received by said first housing and engaging said second housing as said lever member is rotated through a range of motion, said lever member connecting said first and second housings to join corresponding electrical contacts when said lever member is rotated to a final engaged position; and said first housing having a latch assembly that engages said lever member when said lever member is in said final engaged position, said latch assembly having a base piece and a latch cover, said base piece having first and second latches, said second latch engaging said latch cover when said latch assembly is in a pre-engagement stage, said lever member engaging said first latch when rotated to said final engaged position to bias said second latch away from said latch cover thereby enabling said base piece to slide into an engagement stage with respect to said latch cover.

2. The electrical connector assembly of claim 1, wherein said lever member is positioned between said first latch and said latch cover when said base piece is in said engagement stage.

3. The electrical connector assembly of claim 1, wherein said base piece is slidably retained proximate said latch cover by protective ribs extending from a side wall of said first housing, said base piece having shoulder hooks that engage a first end of said protective ribs and a catch strip that engages a second end of said protective ribs to define a slide range of said base piece.

4. The electrical connector assembly of claim 1, wherein said latch cover includes a ledge that resistibly engages said second latch when said latch assembly is in said pre-engagement stage, and wherein engagement of said lever member with said first latch disengages said ledge and said second latch.

5. The electrical connector assembly of claim 1, wherein said lever member includes a release arm and said first housing has an end wall with a locking member, said locking member retaining said release arm to maintain said lever member in an insertion position with respect to said first housing, said second housing having a release member that engages said release arm to release and permit rotation of said lever member when said first and second housings are in an initial mating position.

6. The electrical connector assembly of claim 1, wherein said second housing has a cam blocking member on an end wall, said cam blocking member engaging said cam arm as said first and second housings are placed into an initial mating position with said lever member rotated to an intermediate point along said range of motion.

7. The electrical connector assembly of claim 1, wherein a wire shield extends from said first housing and covers a reception end thereof, said wire shield having feet extending from side walls and a tab extending from a rear wall, said first housing having slots receiving said feet and a catch releasably retaining said tab.

8. The electrical connector assembly of claim 1, wherein said second housing carries said electrical contacts, said electrical contacts having top, intermediate, and bottom portions, said bottom portion having retention features, said second housing having a rear wall retaining said top portions and a template having a chamber receiving said bottom portions, said second housing and said template being mounted to each other to receive an encapsulate material in said chamber encasing said bottom portion about said retention features.

* * * * *